US007762557B2

(12) United States Patent
Davidzon et al.

(10) Patent No.: US 7,762,557 B2
(45) Date of Patent: Jul. 27, 2010

(54) TRIVIA GAME AND METHOD OF PLAY

(76) Inventors: Gregory Davidzon, 2508 Coney Island Ave., 2nd Floor, Brooklyn, NY (US) 11223; Semyon Katsman, 390 5th Ave., Suite 511, New York, NY (US) 10018

( * ) Notice: Subject to any disclaimer, the term of this patent is extended or adjusted under 35 U.S.C. 154(b) by 0 days.

(21) Appl. No.: 11/516,442

(22) Filed: Sep. 6, 2006

(65) Prior Publication Data

US 2008/0054571 A1 Mar. 6, 2008

(51) Int. Cl.
*A63F 1/00* (2006.01)

(52) U.S. Cl. ..... 273/429

(58) Field of Classification Search ..... 273/429–432, 273/139

See application file for complete search history.

(56) References Cited

U.S. PATENT DOCUMENTS 5,359,510 A * 10/1994 Sabaliauskas ..... 700/91
5,779,549 A * 7/1998 Walker et al. ..... 463/42
6,224,486 B1 * 5/2001 Walker et al. ..... 463/42
6,425,828 B2 * 7/2002 Walker et al. ..... 463/42
6,761,631 B2 * 7/2004 Lydon et al. ..... 463/9
6,817,948 B2 * 11/2004 Pascal et al. ..... 463/42
6,908,390 B2 * 6/2005 Nguyen et al. ..... 463/42
7,192,352 B2 * 3/2007 Walker et al. ..... 463/42
7,354,345 B2 * 4/2008 Bortnik et al. ..... 463/42

OTHER PUBLICATIONS http://www.microsoft.com/Presspass/press/2000/oct00/encartabeepr.mspx, "Microsoft Launches Encarta Bee Challenge for the 21st-Century Student", Web article, Oct. 2000.*
http://www.ukgameshows.com/page/index.php?title=Whittle, website describing the game show Whittle, 1997-1998.*
http://www.surfnetkids.com/play_game_shows.htm, Surf the Net with Kids website, Game shows played online, Jun. 2006.*

* cited by examiner

*Primary Examiner*—William M Pierce
(74) *Attorney, Agent, or Firm*—James Ray & Assoc

(57) ABSTRACT

A method of playing a trivia game includes the step of registering a plurality of players to participate in the trivia game. Then, providing a clue to the plurality of players and receiving an answer from each player participating in the trivia game. Next, eliminating players associated with an incorrect answer and allowing players associated with a correct answer to continue participating in the trivia game. The steps of providing the clue, receiving the answer and eliminating players are repeated until one of only one player who provided correct answers remains before the trivia game ended, at least one player who provided correct answers remains when the trivia game ended and all registered players have been eliminated before the trivia game ended.

15 Claims, 1 Drawing Sheet

TRIVIA GAME AND METHOD OF PLAY

FIELD OF THE INVENTION

The present invention relates, in general, to trivia games and, more particularly, this invention relates to a trivia game of a progressively increasing difficulty.

BACKGROUND OF THE INVENTION

Trivia games are well known in the art. One type of such trivia game includes a board with playing pieces which are advanced on a playing path after the player correctly answered a question from a playing card. This type of the trivia game can be generally played by a limited number of players present in the same physical location. Furthermore, players may loose enthusiasm in playing a particular board game by learning or memorizing answers to each playing card.

Another type of trivia game known as "Who Wants To Be A Millionaire" presents a player selected from a narrow pool of eligible players present in a production studio with a question and four possible answers, one of which is a correct answer. If the player chooses the correct answer, he or she moves to the next level of a progressively increased difficulty. The game ends when one of the player correctly answers all questions and collects the grand prize, when the player chooses an incorrect answer at any level or when the player decides to quite playing.

In order to be selected into the eligible pool, interested players must compete in and win various qualification rounds. Accordingly, this type of game is generally played by selected members of the general public who successfully completed qualification rounds.

Yet another type of trivia game is a well known crossword puzzle that is characterized by an answer grid having a plurality of interconnected cells arranged in a row and column manner. Certain cells in a first portion of such plurality of cells is blackened and certain cells in a second portion of such predetermined plurality of cell is designated to contain one specific letter of an alphabet. Selected cells in the second portion are distinctly and sequentially numbered for aiding in solving the crossword puzzle.

Prior to the present invention, the listing of clues is disposed next to the answer grid. As with other types of trivia games, the crossword puzzle is generally solved by a single person.

SUMMARY OF THE INVENTION

The present invention overcomes disadvantages of prior art trivia games by providing a novel method of playing a trivia game by a larger percentage of the general public. According to one embodiment of the invention, the method includes the step of registering a plurality of players to participate in the trivia game. Then, providing a clue to the plurality of players. Next, receiving an answer from each player participating in the trivia game. Then, eliminating players associated with an incorrect answer. Allowing players associated with a correct answer to continue participating in the trivia game. The steps of providing the clue, receiving the answer, eliminating players and allowing player to continue playing the trivia game are repeated until one of only one player who provided correct answers remains before the trivia game ended, at least one player who provided correct answers remains when the trivia game ended and all registered players have been eliminated before the trivia game ended.

According to another embodiment of the invention, the method includes the step of registering a plurality of players to participate in the trivia game. Next, providing a clue to the plurality of players. Then, receiving an answer from each player participating in the trivia game. Awarding a score to each answer. Then, saving the awarded score to a database. Finally, repeating the steps of providing the clue, receiving the answer and awarding the score to each answer until the trivia game ends.

According to yet another embodiment, the method includes the step of registering a plurality of players to participate in solving the crossword puzzle. Next, providing a crossword puzzle answer grid having a plurality of interconnected cells arranged in a row and a column manner. Having certain cells in a first portion of the plurality of cells blackened and having certain cell in a second portion of the predetermined plurality of cells designated to contain one specific letter of an alphabet. Selected cells in the second portion are distinctly and sequentially numbered for aiding in solving the crossword puzzle. The method contemplates randomly selecting one player from the plurality of players participating in solving the crossword puzzle. Then, providing a clue in combination with a numbered cell and one of a row and a column orientation of the clue to the randomly selected player. Next, receiving an answer from the randomly selected player. Soliciting remaining participating players to agree or disagree with the answer received from the randomly selected player. Then, receiving an answer from the remaining players participating in solving the crossword puzzle. Next, continuing solving the crossword puzzle by way of awarding a score to the received answer or eliminating players associated with an incorrect answer. Finally, repeating the steps of providing the clue, receiving the answer and either awarding the score or eliminating players who provided an incorrect answer until one of the following conditions: the crossword puzzle is solved, a predetermined time limit has expired and only one player remains prior to one of the crossword puzzle being solved and the predetermined time limit being expired.

OBJECTS OF THE INVENTION

It is, therefore, one of the primary objects of the present invention to provide a method of playing a trivia game.

Another object of the present invention is to provide a method of playing a trivia game of progressively increasing difficulty.

Yet another object of the present invention is to provide a method of playing a trivia game by a larger percentage of the general public.

A further object of the present invention is to provide a method of playing a trivia game enabling only the players who provided correct answers to advance to the next level.

Yet a further object of the present invention is to provide method of playing a trivia game that enables all registered players to compete in all levels of the game.

An additional object of the present invention is to provide a method of playing a trivia game that enables each player to be located in a distinct remote location.

Another object of the present invention is to provide a method of playing a trivia game by way of phone or Internet.

Yet another object of the present invention is to provide a method of playing a trivia game wherein each winner receives an award.

A further object of the present invention is to provide a method of playing a trivia game enabling promotion of sponsors of such trivia game.

In addition to the several objects and advantages of the present invention which have been described with some degree of specificity above, various other objects and advantages of the invention will become more readily apparent to those persons who are skilled in the relevant art, particularly, when such description is taken in conjunction with the appended claims.

BRIEF DESCRIPTION OF THE VARIOUS EMBODIMENTS OF THE INVENTION

Figure 1:
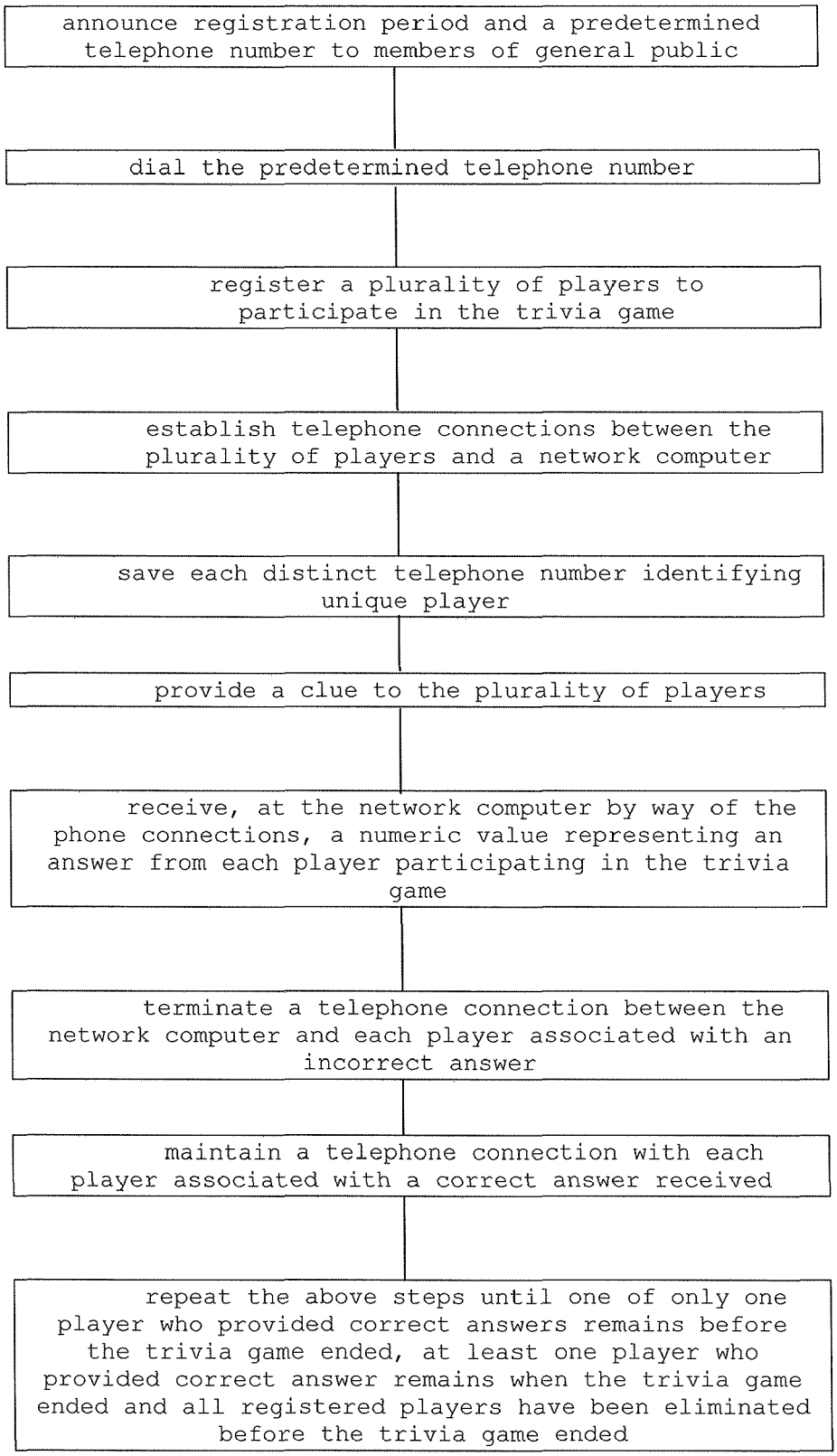
FIG. 1 contains the flowchart of the method of playing trivia game.

According to a first embodiment, the present invention provides a method of playing a trivia game by a larger percentage of the general public than presently possible with prior art trivia games. The basic method includes the steps of registering a plurality of players to participate in the trivia game. Advantageously, this method enables each player to be located in a distinct remote location and registered by way of at least one of a phone connection and a computer or other electronic devices, for example, a Personal Digital Assistant (PDA), connected to the Internet.

The Internet connection may include a Voice over Internet Protocol (VoIP) capability. In either case, during the registration period, each player dials a phone number announced by at least one of radio, phone, TV and Internet. For example, the announcement of the registration period may be translated by way of radio when the player selects a predetermined radio station. Or the announcement may be communicated by way of a TV set when the player selects a predetermined programming channel.

When the player dials a provided phone number, the player is connected to a network computer. A phone number of each player registering for the game is used as a player identification number and is saved to a database. When the phone number of the player attempting to register cannot be recognized by the caller identification feature of the registration network computer, the player will be informed to manually enter his or her phone number in order to continue with the registration.

The registration period may be limited to a preselected period of time or to a predetermined maximum number of players allowed to register.

Optional periodic announcements communicated during the registration period may provide information on remaining time, remaining number of players to be registered, trivia game program sponsors and the like. These announcements may be generated by the network computer or may be announced by a live host of this trivia game program.

When the registration period ends, the trivia game begins by providing a clue to the plurality of participating players. Such clue may be one of a question and an assertion. When the players are located in distinct remote locations the clue is communicated by at least one of radio, phone, TV and Internet. The clue is selected from a category being one of history, science, geography, events, current events, art, literature, music, entertainment, sports, health, people and various combinations thereof.

Next, an answer is received from each player participating in the trivia game. To achieve this, each player uses a phone keypad or a keyboard of the Internet connected computer or other device such as the PDA, to enter the answer. Preferably, to at least expedite completion of the trivia game, the method includes the step of providing, by way of the live host or a computer generated preselected message, a possible answer in combination with a response instructional message.

For example, the response instructional message informs players to dial "1" to agree or dial "2" to disagree with the provided possible answer. Each player must then dial "1" or "2" to continue playing the game.

Optionally, one of the players participating in the game is selected, preferably randomly, by the program host or by the network computer to provide such possible answer, which is then announced to all other players.

In the presently preferred embodiment of the invention, the method includes the step of providing three possible answers after providing the clue to all participating players, wherein one of the three possible answers is a correct answer. Each player must then dial "1" to select the first answer, dial "2" to select the second answer and dial "3" to select the third answer.

After the answer from each player is received, players who provided the incorrect answer are eliminated from the trivia game. The elimination is simply achieved by disconnecting the connection between the player who provided the incorrect answer and the network computer. The players who provided correct answer are allowed to continue participating in the trivia game and move to the next level or phase.

The method contemplates the step of providing a preselected time interval for receiving the answer from each player in order to fit the entire trivia game into the allotted preselected time period. Players who did not provide the answer during the preselected time interval are also eliminated. Advantageously, the method includes the step of periodically annunciating a time remaining from the preselected time interval to players still participating in the trivia game. The clue and possible answers may also be repeated during this preselected time interval.

The steps of providing the clue to and receiving an answer from participating players and eliminating players who provided incorrect answers are repeated until one of the following conditions occur. According to a first condition, only one player who provided correct answers remains prior to the trivia game being completed. According to a second condition, at least one player who provided correct answers remains when the trivia game ended. And, according to a third condition, all registered players have been eliminated before the trivia game ended.

Accordingly, the trivia game includes a predetermined plurality of game levels. It will be appreciated that in order to challenge players participating in the trivia game, each subsequent game level is characterized by a progressively increasing difficulty of the clue provided to such players. The method includes the step of communicating the number of game levels to the players prior to providing the first clue and may include the step of informing players about the game level number to be played next. If more than one player correctly answered all questions, the trivia game ends by playing a last one of such predetermined plurality of game levels.

The method may further include the step of rewarding the single remaining player who provided correct answers before the trivia game ended or the at least one remaining player who provided correct answers when the trivia game ended by way of at least one of a monetary and a non-monetary award.

The method may additionally include the step of awarding a score to each answer. By way of example, each correct answer receives a score being equal to one point and each incorrect answer receives the score being equal to zero points, although other point scoring systems may be utilized in the present invention.

Next, each awarded score for each player is saved to a database, wherein each player is identified by the phone number provided by the player during the registration period. Accordingly, even the players who were eliminated early in the trivia game have an opportunity to earn at least one point and accumulate points by playing more than one trivia game.

The method contemplates that the players may play the trivia game for free or may be required to pay for the opportunity to participate in the trivia game by providing a credit card or debit car information during the registration period or by being charged through a phone company or Internet provider when dialing the predetermined phone number. The payments received from players may be then used for compensating equipment and programming expenses and for providing monetary awards.

The method further contemplates the step of soliciting various businesses, organizations and individuals to sponsor the trivia game and provides for promoting at least one sponsor during the game. In addition, or as an alternative to monetary contributions, the sponsor may offer coupons, discounts, products, services and the like to the single winner or multiple winners of the trivia game.

It will be appreciated that with the above method, a larger percentage of the general public can participate in playing the trivia game with the total number of participating players essentially limited to the capabilities of the network computer and incoming phone line and Internet connections. Accordingly, the method contemplates continuous expansion of the network and connectivity capabilities to accommodate increasing interest in playing the trivia game.

Furthermore, it will be appreciated, that a plurality of trivia games may be scheduled and played at a predetermined time intervals with new questions being selected for each trivia game.

According to a second embodiment of the invention, there is provided a method of playing a trivia game which includes the steps of registering a plurality of players to participate in the trivia game, then providing a clue to participating players and receiving an answer from each player participating in the trivia game in a manner according and identical to the first embodiment of the invention described above.

Then, instead of eliminating players who provided incorrect answers, the method includes the step of awarding a score to each answer. By way of example, each correct answer receives a score being equal to one and each incorrect answer receives the score being equal to zero, although other point scoring systems may be utilized in the present invention.

Next, each awarded score for each player is saved to a database, wherein each player is identified by the phone number provided by the player during the registration period. The steps of providing the clue to and receiving answers from participating players and awarding scores to each answer are repeated until the trivia game ends either when all game levels have been played or when the allotted preselected program time has expired.

The method further includes the step of declaring at least one winner who has a highest score when the game ends. The method contemplates an additional step of declaring at least one winner who has a highest score after a predetermined period of time such as a week, month, year and the like has expired.

It will be apparent to those skilled in the relevant art form that the method according to the first or second embodiment of the present invention may be employed for playing a trivia game such as a crossword puzzle, wherein each level represents a new word to be identified and inserted into a predetermined position within the crossword puzzle grid.

According to a third embodiment, the invention provides a novel method of solving a crossword puzzle that is characterized by a plurality of interconnected cells arranged in a row and column manner. Certain cells in a first portion of such plurality of cells is blackened and certain cells in a second portion of such predetermined plurality of cells is designated to contain one specific letter of an alphabet.

Selected cells in the second portion are distinctly and sequentially numbered for aiding in solving the crossword puzzle. When the players are located in distinct remote locations, the crossword puzzle grid may be provided by way of a printed publication, by way of a TV program or by way of a computer or other electronic device having a display and being connected to the Internet. For example, a phone having a display or the PDA may be utilized for solving the crossword puzzle.

Such method includes the steps of registering a plurality of players to participate in solving the crossword puzzle. Next, randomly selecting one player from the plurality of players participating in solving the crossword puzzle. Then, providing a clue in combination with a numbered cell and one of a row and column disposition of such clue to such randomly selected player.

Next, receiving an answer from the randomly selected player. Then, soliciting remaining players participating in solving the crossword puzzle to agree or disagree with the answer received from the selected player and receiving an answer from each of the remaining players participating in solving the crossword puzzle. If the selected player provided an incorrect answer as determined by the program host or by the network computer, additional players may be selected to provide another answer until a correct answer has been provided or the program host may provide such correct answer.

Continuing solving the crossword puzzle by way of one of awarding a score to the received answer and eliminating players who provided an incorrect answer. The steps of providing the clue, receiving the answer and awarding the score or eliminating players are repeated until one of the following conditions occurs. According to a first condition, the crossword puzzle is solved. According to a second condition, a predetermined time limit has expired. And according to a third condition, only one player remains prior to one of the crossword puzzle being solved and the predetermined time limit being expired.

It will be understood that the steps of registering players, providing the clue, receiving answers, awarding the score or eliminating players in order to solve the crossword puzzle are identical to the same steps described above for playing the trivia game and will not be repeated for the sake of brevity.

Although the present invention has been shown in terms of the players being disposed in distinct remote locations, it will be apparent to those skilled in the art, that the present invention of playing the trivia game and solving the crossword puzzle may be applied to players being located in a production studio. In such embodiment, the players may pre-register according to the registration process described above or may simply participate by being admitted into the production studio. The clues may be provided by way of a display or a verbal announcement by the program host and answers will be provided by way of a well known audience response system utilizing hand-held keypad computer terminals.

Thus, the present invention has been described in such full, clear, concise and exact terms as to enable any person skilled in the art to which it pertains to use the same. It will be understood that variations, modifications, equivalents and substitutions for components of the specifically described embodiments of the invention may be made by those skilled in the art without departing from the spirit and scope of the invention as set forth in the appended claims.

We claim:

1. A method of playing a trivia game, said method comprising the steps of:

(a) announcing, by at least one of radio, phone, TV and Internet, each of a registration period and a predetermined telephone number to members of general public;

(b) dialing, by said members of said general public by way of said at least one of a phone, mobile communication device and Internet, said predetermined telephone number announced in step (a);

(c) registering a plurality of players from said members of said general public, dialing said predetermined telephone number by way of said at least one of a phone, mobile communication device and Internet, to participate in said trivia game;

(d) establishing telephone connections between said plurality of players and a network computer;

(e) saving each distinct telephone number identifying a respective one of said plurality of players registered in step (c) to a database;

(f) providing a clue to said plurality of players;

(g) receiving, at said network computer by way of said phone connections, a numeric value representing an answer from each player participating in said trivia game;

(h) terminating a telephone connection between said network computer and each player associated with an incorrect answer received in step (g);

(i) maintaining a telephone connection with each player associated with a correct answer received in step (g); and (j) repeating steps (f) through (i) until one of only one player who provided correct answers remains before said trivia game ended, at least one player who provided correct answers remains when said trivia game ended and all players registered in step (c) have been eliminated before said trivia game ended.

2. The method, according to claim 1, wherein said method includes the additional step of providing a possible answer to said clue provided in step (f).

3. The method, according to claim 2, wherein said step of providing said possible answer includes the step of randomly selecting, by one of a program host and said network computer, one of said plurality of players and the step of announcing said possible answer.

4. The method, according to claim 1, wherein said method further includes the step of providing three possible answers after providing said clue in step (f) and wherein one of said three possible answers is a correct answer.

5. The method, according to claim 4, wherein said answer received in step (g) is any one of said three possible answers.

6. The method, according to claim 1, wherein said method further includes the step of providing a preselected time interval for receiving said answer in step (g) after providing said clue in step (f).

7. The method, according to claim 6, wherein said method further includes the step of eliminating players, by disconnecting their respective phone connection by way of said network computer, whose answer was received after said preselected time interval.

8. The method, according to claim 1, wherein said trivia games includes a predetermined plurality of game levels.

9. The method, according to claim 8, wherein each subsequent game level is characterized by progressively increasing a difficulty of said clue provided in step (f).

10. The method, according to claim 1, wherein said clue provided in step (f) is selected from a category being one of history, science, geography, events, current events, art, literature, music, entertainment, sports, health, people and various combinations thereof.

11. The method, according to claim 1, wherein said plurality of players participating in said trivia game are located in a production studio.

12. The method, according to claim 1, wherein said each player is located in a distinct remote location from one another, wherein said clue is provided in step (f) by at least one of a radio, phone, TV and Internet owned by said each player, and wherein said answer received in step (g) is by way of at least one of said phone, said mobile communication device and said Internet owned by said each player.

13. The method, according to claim 1, wherein said method further includes the step of rewarding one of said one remaining player who provided correct answers before said trivia game ended and said at least one remaining player who provided correct answers when said trivia game ended by way of at least one of a monetary and a non-monetary award.

14. The method, according to claim 1, wherein said method further includes the step of promoting at least one sponsor of said trivia game.

15. The method, according to claim 1, wherein said step of registering said plurality of players includes the step of providing at least one of a preselected period of time and a predetermined maximum number of players allowed to register and the step of periodically announcing at least one of a remaining time and remaining number of players to be registered, respectively.

* * * * *